US007334271B2

(12) United States Patent
Jung

(10) Patent No.: US 7,334,271 B2
(45) Date of Patent: Feb. 26, 2008

(54) HANDS-FREE TOILET SEAT CONTROL

(76) Inventor: Man-Young Jung, 2750 Washington Blvd., Suite 150, Pasadena, CA (US) 91107

( * ) Notice: Subject to any disclaimer, the term of this patent is extended or adjusted under 35 U.S.C. 154(b) by 393 days.

(21) Appl. No.: 11/170,031

(22) Filed: Jun. 29, 2005

(65) Prior Publication Data

US 2007/0000036 A1 Jan. 4, 2007

(51) Int. Cl.
*A47K 13/10* (2006.01)

(52) U.S. Cl. ..... 4/246.1

(58) Field of Classification Search ..... 4/246.1–246.5

See application file for complete search history.

(56) References Cited

U.S. PATENT DOCUMENTS 4,055,864 A * 11/1977 Liu et al. ..... 4/253
5,659,902 A * 8/1997 Roberts, Jr. ..... 4/246.3

* cited by examiner

*Primary Examiner*—Charles E. Phillips
(74) *Attorney, Agent, or Firm*—Clement Cheng, Esq.

(57) ABSTRACT

An improved toilet seat lifter is provided by a hands-free toilet seat control for controlling the positions of the toilet seat comprising a safety ratchet pedal connected to a gear/wheel unit which transmits the transitional or rotational ratchet movements of the pedal into an amplified circular push and pull of a control rod connected to the toilet seat via universal joints. The swivel control bar moved by the floor level pedal characterizes the toilet seat control of an embodiment of the present invention. The gear/wheel unit is rotated in a single direction to push and pull the control rod while counteracting the gravity fall of the seat to keep control. The simple but positive transmission of the transitional or rotational ratchet movements to the control rod allows for a power-assisted actuation of the gear/wheel unit and thus the toilet seat. An electric linear actuator can be connected to the ratchet pedal in parallel providing an auxiliary mechanism to rotate the gear/wheel unit using a remote control, which can be fixed at a convenient location near the toilet.

10 Claims, 3 Drawing Sheets

HANDS-FREE TOILET SEAT CONTROL

BACKGROUND OF THE INVENTION

A. Field of the Invention

The present invention relates to toilet seats, and more particularly to a toilet seat control which leaves the user's hands free for sanitary and convenience or other purposes.

B. Description of the Prior Art

The first step of using a shared toilet bowl is to decide the up or down position of the toilet seat and move it or leave it at the desired position every other time. Devices have been suggested to avoid hands touching toilet seats shared by others of different nature in maintaining toilet sanitation. One improvement is suggested by U.S. patent application Ser. No. 10/860,045 with a foot actuated toilet seat lifter having a combination of levers connecting foot lever directly to the toilet seat wherein depression of the foot lever causes the levers to pivot to lift the seat.

U.S. patent application Ser. No. 10/721,515 shows a foot-operated toilet seat having two geared shafts connected between a foot lever and the toilet seat. Depression of the foot lever lifts the toilet seat against gravity, which forces the seat to the resting position with the release of the foot lever.

U.S. Pat. No. 4,534,073 to Smith discloses a toilet seat lifter with a leverage system wherein a foot pedal positioned at a height above the floor is stepped on by the user to leverage the toilet seat to an upright position at which the seat is held on.

U.S. Pat. No. 4,803,741 to Ellison describes a toilet seat lifter with a foot lever, which should be stepped on to keep the seat raised.

U.S. Pat. No. 4,975,988 to Won discloses a foot-operated toilet seat lifting and lowering mechanism which comprises a cable-operated foot lever and a crank to be installed on the toilet seat hinge. The foot lever may be depressed and locked in position to hold the seat up and released by a mechanism at the lever to lower the seat under the gravity.

U.S. Pat. No. 5,487,192 to Hodges discloses an apparatus for the raising and self-lowering a toilet seat which uses a set of levers requiring leg and foot motions trained to press down a foot lever all the while the toilet is used by the standee, gentleman.

In these and other prior art devices, sophisticated leg and foot motions are required to control the lifting and lowering the seat which does not justify the elaborate configuration of mechanical components, which are expensive to make and thus to sell. These direct actuation mechanisms require the operators to bear the direct load of the toilet seat at the foot. One or two misses of pedal manipulation at a segment of the actuation cycle would slam the seat down to the bowl giving nuisance to the others. Retail stores would not like to deal with novelty goods with good possibility of returns straight from someone's toilet seat.

U.S. Pat. No. 5,444,877 to Kumarasurier suggests a foot actuated double acting lever for lifting a toilet seat installed in place of the existing toilet seat hinge. The lever is made possible by a complex gear set and a lock catch surrounding a ratchet mechanism to allow a successive foot pedaling for rotating the seat or a lid between its locked lifted position and lowered position.

In spite of their contributions to the sophistication in the imaginary bathroom scene, new toilets are still built and operated without the need of adding the complexity or cost of seat lifters which are less attractive to bear.

SUMMARY OF THE INVENTION

In view of the foregoing advancement in the art, the present invention is to introduce an improvement in usability and mechanical effectiveness of controlling the positions of the toilet seat by providing a hands-free toilet seat control comprising a safety ratchet pedal connected to a gear/wheel unit which transmits the transitional or rotational ratchet movements of the pedal into an amplified circular push and pull of a control rod connected to the toilet seat via universal joints.

The swivel control bar moved by the floor level pedal characterizes the toilet seat control of the present invention. The gear/wheel unit is rotated in a single direction to push and pull the control rod while counteracting the gravity fall of the seat to keep control even by someone first to the device. The simple but positive transmission of the transitional or rotational ratchet movements to the control rod allows for electric power motor assisted actuation of the gear/wheel unit and thus the toilet seat. An electric linear actuator can be connected to the ratchet pedal in parallel providing an auxiliary mechanism to rotate the gear/wheel unit using a remote control, which can be fixed on a restroom wall.

Accordingly, the general object of the present invention is to provide a hands-free toilet seat control, which employs a single-gear ratchet mechanism to achieve a positive and consistent control of toilet seat positioning.

Another object is to provide a transmission mechanism for toilet seat where a single direction of rotation pushes and pulls the control rod while counteracting the gravity fall of the seat to keep control even by a novice to the device.

Yet another object is to provide the same transmission mechanism for toilet seat adapted for a power assisted positioning of the seat by an addition of electric actuator in parallel to the manual pedal actuator.

Yet another object is to provide a hands-free toilet seat control, which can be adapted for integration into a portable toilet production as well as instant retrofitting to existing toilet fixtures.

Embodiments of the invention will now be described by way of example with reference to the accompanying drawings whereby the invention should not be limited in the scale as shown. For example, the entire control device can be miniaturized to be clipped on the rim of the toilet bowl for a power assisted operation though an electric motorized actuator and an accompanying remote control without departing from the scope of the invention.

DETAILED DESCRIPTION OF THE PREFERRED EMBODIMENT

Figure 1:
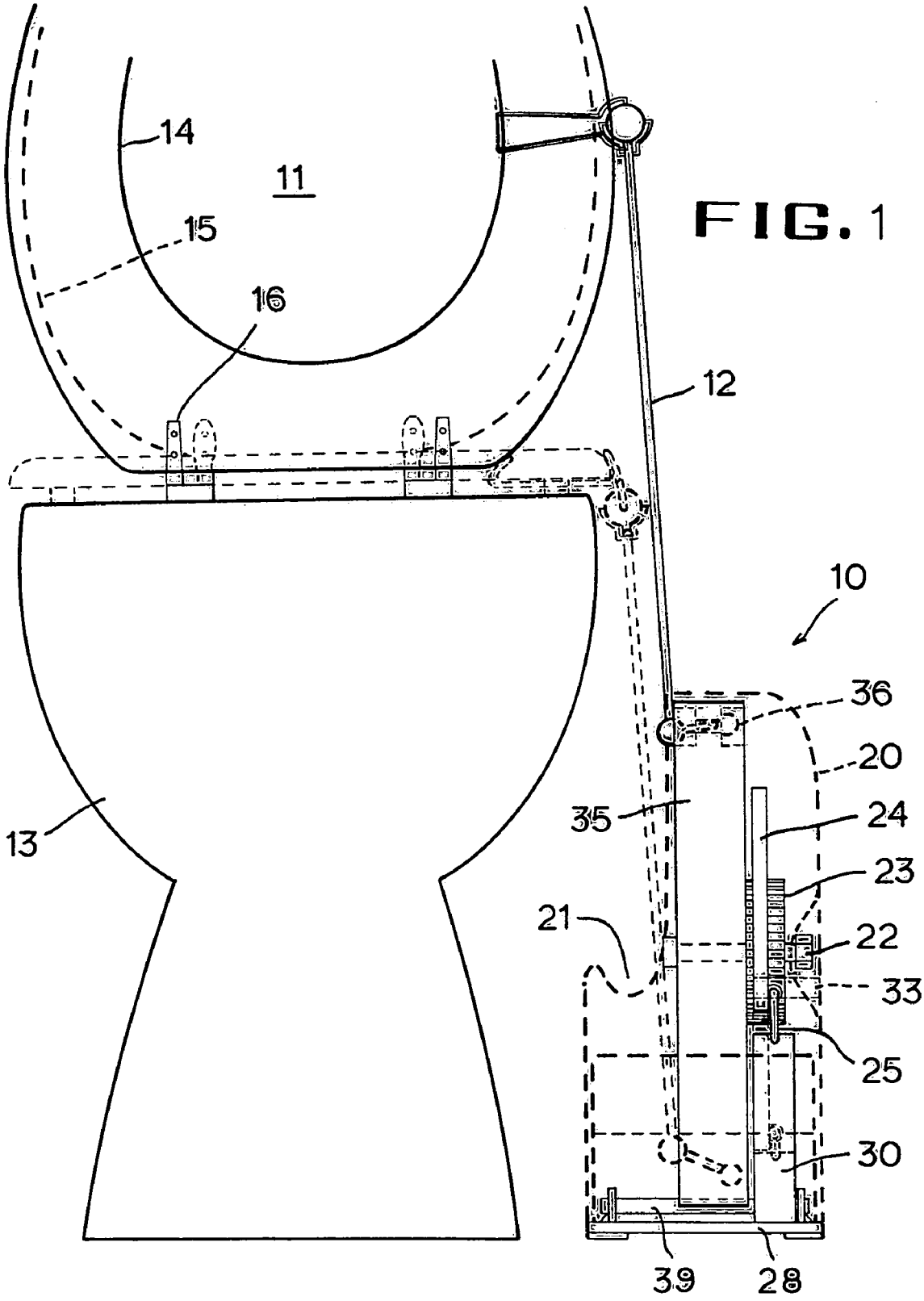
FIG. 1 is a front view of the hands-free toilet seat control of one embodiment of the present invention in use.

Referring to FIG. 1, the toilet seat control generally designated as 10 sits besides a toilet bowl or toilet 11 and connected thereto by a control rod 12, which can swivel at its both ends through universal joints with the seat control 10 as well as the toilet 11. The toilet 11 is of the type that has a bowl 13, seat 14 and lid 15 both pivotally connected to the bowl 13 with a pair of hinges 15. The lid 15 is positioned over the seat 14 so that the seat 14 is lifted always together with the lid 15. This arrangement made the toilet versatile for universal use by anyone but also has created the necessity for hands-free positioning of the seat for the sake of personal hygiene from sharing it with the others that the seat control of the present invention will provide.

Figure 2:
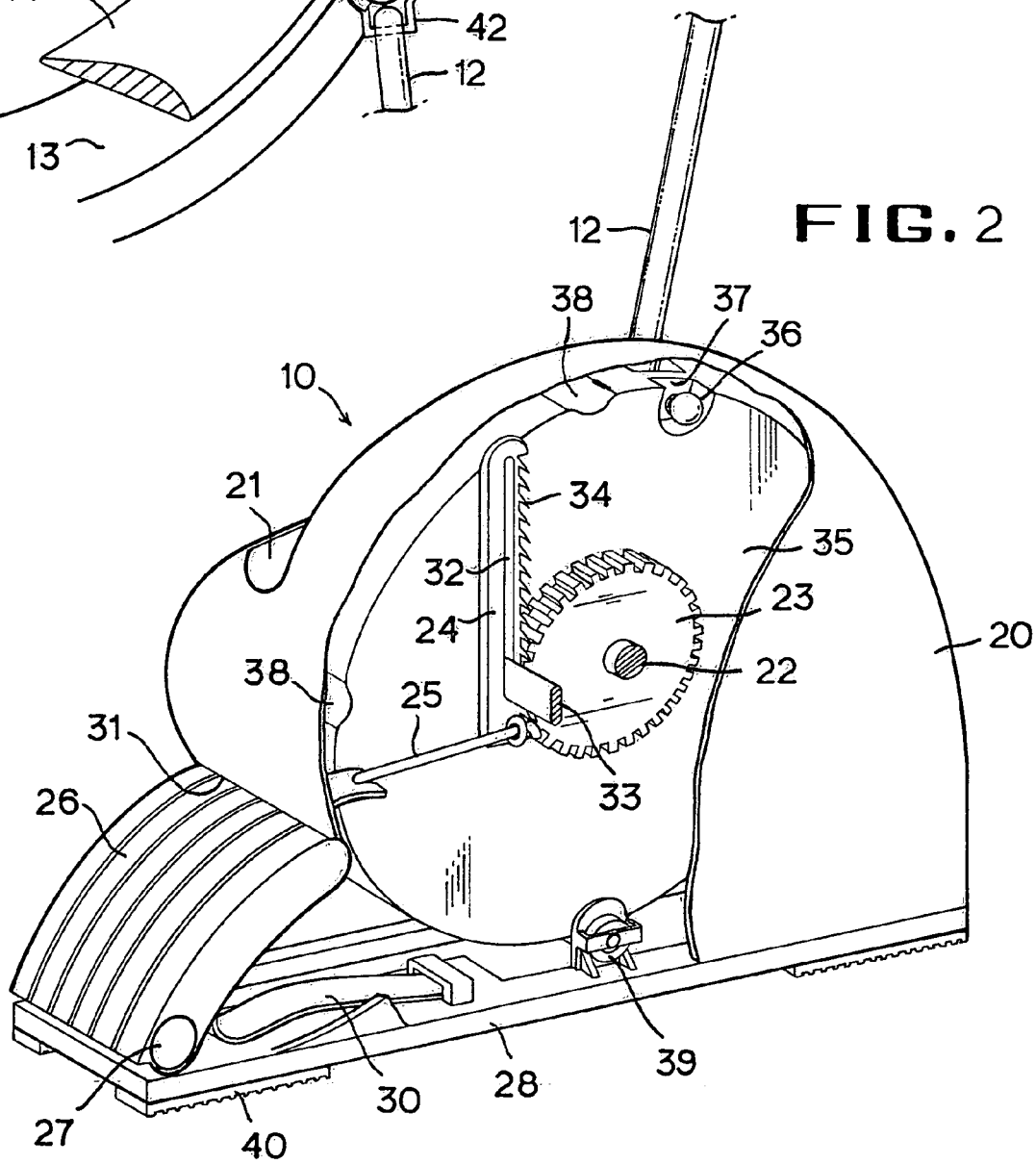
FIG. 2 is a perspective view of the toilet seat control with a partial cut-away to show its operational mechanism.

As will be easily understood with further reference to FIG. 2, the seat control 10 has an upper housing 20 generally covering the moving components of the seat control 10 leaving an opening 21 at the side toward the toilet 11 to which the control rod 12 extends and swivels to effect lifting and lowering of the seat 14.

Away from the toilet 11 at the visible side of the housing 20 there is a center axle 22 cantilevered to the housing 20. Though the axle 22 may be a separate member cantilevered to the housing wall with the fastening mechanism of one or more nuts and washers, it can be formed integral to the housing. On the axle 22 a gear 23 is mounted for free rotations until it is regulated by a ratchet link 24, one end of which is linked through a transitional rod 25 to an oversized pedal 26.

The pedal 26 is mounted on a pivoting hinge 27 to a base 28, which also supports the rest of the seat control 10 at a slightly raised level for sanitary maintenance purpose. A C-shaped leaf spring 30 biases the pedal to its highest swivel level limited by the front edge 31 of the housing 20 while the overall height of the pedal 26 can be set so that the operator is not required to raise the leg in an unstable posture.

The spring 30 and rod 25 are held under the pedal 26 to translate the depressions of the biased pedal 26 into the transitional oscillation of the ratchet link 24. The link 24 has a longitudinal slot 32 through which a guide bar 33 extends in a cantilevered arrangement from the housing 20. The link 24 may be formed integral to the housing 20 of plastic and can flex laterally to assist in its ratcheting operation. Along its edge facing the gear 23 the link 24 has a series of ratchet pawls 34. Due to the sliding connection with the guide bar 33, the link 24 keeps its longitudinal path of movement in the ratcheting mesh with the gear 23.

In the illustrative embodiment of the present invention, the ratchet gear arrangement is set so that one depression of the pedal gives a quarter turn of the gear 23 although it is a matter of changing the gear sizes and teeth design to increase the amount of the turn such as to a half or 180° turn of the gear 23.

Joined to the gear 23 on the same axle 22 is a weight wheel 35 for multiplying the amount of rotation of the gear 23 to effect a large circular movement of the control rod 12. The big sister wheel 35 is freely rotational on the axle 22 and fastened to the gear 23 for movement along. To a point near the circumference of the wheel 35 the control rod 12 is connected at one end through a universal link, which consists of a ball mechanism 36 threaded through a narrow wall 37 providing a planetary axis of rotation of the control rod 12 about the axle 22.

In addition, the big wheel 35 has four diagonally positioned indentations 38, shallow notches parallel to the axle 22. One of the notches 38 that comes down to the bottom upon depression of the pedal 26 will engage a support roller 39 rotationally fixed to the base 28, when the rotation of the wheel 35 is halted until another depression of the pedal occurs. So the wheel notches 38 and roller 39 constitute a dampening mechanism to prevent uncontrolled movement of the rod 12 by the counteracting weight of the seat 14. The dampening mechanism also calibrates the set positions of the control bar 12 automatically to ensure the correct cyclic movement of the toilet seat 14 always.

At each corner of the base 28 an anti-slip pad 40 is attached for holding the housing and its content in place even on a wet floor of the restroom. Alternatively, suction cups at the four corners on the bottom side of the base will carry out the similar duty.

Auxiliary to the ratchet pedal 26, a linear electric actuator can be installed in parallel for automation of the control rod actuation through a trip switch or a remote control fixed on a restroom wall in which embodiment the pedal 26 is still available for manual lifting and lowering of the seat 14. In order to regulate the movement of the control rod 12 to stop at its correct lifted or lowered position the wheel 35 may be fitted with a pair of circuit break members at its diagonally opposite areas to make the circular contacts with the circuit of the actuator to deenergize the same automatically in a timely manner when the seat 14 is in either its raised or lowered positions.

Figure 3:
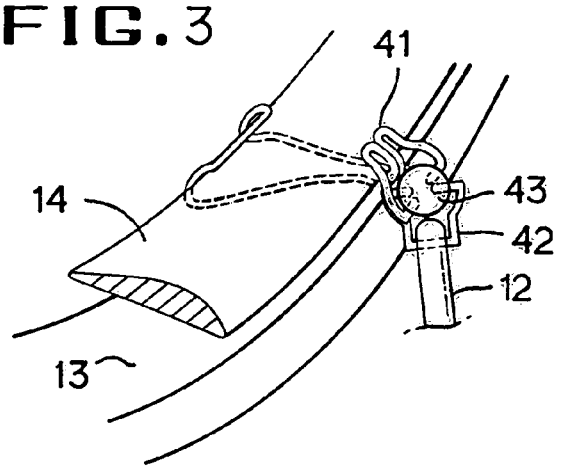
FIG. 3 is a perspective view of the universal joint of the control rod with the toilet seat in its down-position.

FIG. 3 shows the other end of the control rod 12 connected to the seat 14 in its resting position on the bowl 13 through a universal joint consisted of a seat bracket 41 which clips on the bottom side of the seat 14, an articulating bracket 42 attached to the rod 12 and a sphere member 43 interconnecting the free ends of the brackets 41 and 42. Brackets 41 and 42 may be made of shaped wires with an appropriate thickness and surface finished for sanitation in the restroom environment.

When such construction of seat control 10 is installed on the toilet 11 with the seat 14 in its initial raised position as shown in FIGS. 1 and 2, a user can step on the pedal 26 to press it down. Then, the transmission rod 25 pulls down the link 24 in mesh with the gear 23 to turn the same in counterclockwise direction. The wheel 35 follows the gear turn over a bigger track of movement as does the control bar 12 connected to the circumferential point of the wheel 35 into a mid-level substantially horizontal to the axle 22. This results in a 45° turn of the seat 14 downward. When the user steps out for a second depression of the pedal 26 to further advance the seat 14, the pedal 26 springs back to its upper level raising the transmission rod 25 and the link 24 in unison as the pawls 34 disengage from the gear 23 teeth with the assistance of the flexible guide bar 23 and the dampening mechanism of the notch 38 and the roller 39. The second depression of the pedal 26 will lower the control bar 12 and thus the toilet seat 14 to its horizontal resting position.

Then, the user can have a seat to use the toilet. If it is desired to raise the seat to its lifted position by the next toilet user, similar depressions in succession will effect the same. The illustrative embodiment involves four pedaling actions to complete a cycle, i.e. four steps on the pedal from the initial position of the seat 14 back to the same position although configuration is available to allow two steps completing a seat lift or descend cycle.

Figure 4:
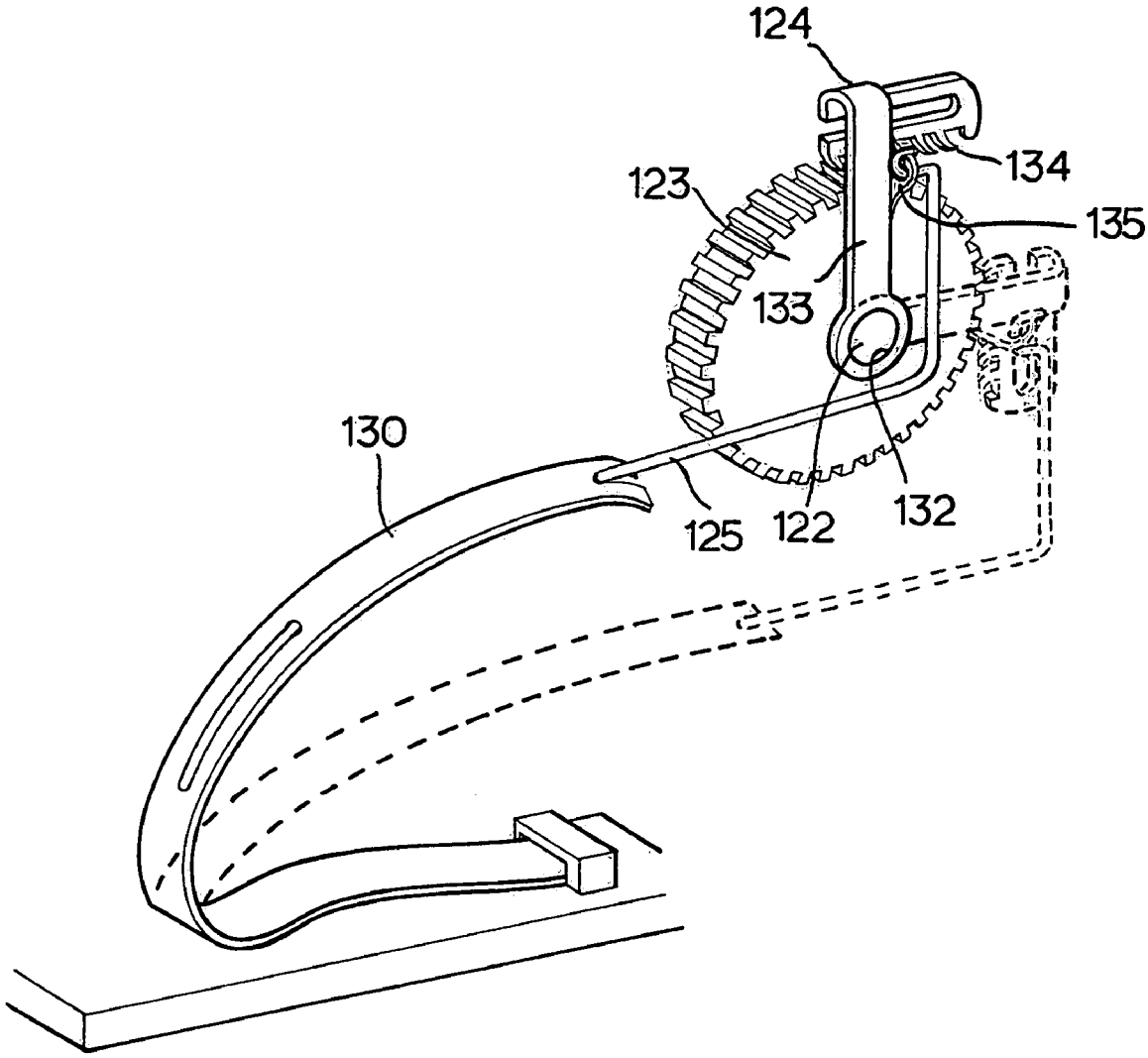
FIG. 4 is rotational ratchet mode of pedal connected to the gear/wheel unit according to another embodiment of the present invention.

Alternatively to the transitional oscillation provided by the FIG. 3 embodiment employing the longitudinal link 24, the present invention has another embodiment where rotational oscillation provides the similar movements of the control rod 12. As shown in FIG. 4, a transmission rod 125 is biased toward an upper position by a leaf spring 130 holding an end of the rod 125 under a pedal not shown. The other end of the rod 125 is operatively connected to a gear 123 through a rotational ratchet link 124. The link 124 has an axle opening 132 for mounting the link 124 on the common axle 122 of the gear 123, an arm 133, a set of ratchet pawls 134 cantilevered flexibly to the arm 133 and an eyelet 135 for hooking the other end of the rod 125.

Upon depression of the transmission rod 125 through the spring biased pedal the rotational link 124 forces the gear 123 into a clockwise rotation through a quarter or half turn depending on the gear configuration. Releasing the pedal will return the link 124 to its upright position with the pawls 134 riding over the gear teeth with the assistance of their resilient arrangement against the gear and the dampening mechanism of the notches 38 and the roller 39 as discussed with reference to FIG. 2.

At the press of the pedal 26, the transmission rod 125 rotates the link 124 in mesh with the gear 123 to clockwise direction. The wheel 35 follows the gear turn over a bigger track of movement as does the control bar 12 connected to the circumferential point of the wheel 35 into a mid-level substantially horizontal to the axle 122. This results in a 45° turn of the seat 14 downward. When the user steps out for a second depression of the pedal 26 to further advance the seat 14, the pedal 26 springs back to its upper level rotating the link 24 counterclockwise direction as the pawls 134 disengage from the teeth of the gear 123. The second depression of the pedal 26 will lower the control bar 12 to its bottom position and thus the toilet seat 14 to its horizontal resting position.

The present invention contemplates that many changes and modifications may be made. For example, the inventive toilet seat control has been described as applied to toilet fixtures for use in household and commercial installations but it is also intended for use with portable toilets generally made of plastics. In such application, the same principles of the present invention may be integrated into the whole manufacturing process of the same toilet as long as the toilet seat feature is utilized.

Therefore, while the presently preferred form of the toilet control has been shown and described, and several modifications thereof discussed, persons skilled in this art will readily appreciate that various additional changes and modifications may be made without departing from the spirit of the invention, as defined and differentiated by the following claims.

The invention claimed is:

1. A hands-free toilet seat control responsive to foot depressions to cycle a toilet seat between lifted and lowered positions comprising:

a. a housing having an opening;

b. a gear rotationally mounted on a horizontal axle inside the housing;

c. a ratchet mechanism having a pedal at one end and an oscillating member disposed at an opposite end, wherein the oscillating member is in ratcheting mesh with the gear to rotate the gear in a single direction when the pedal is depressed;

d. a large wheel fixed to the gear for amplifying the gear rotation into a succession of larger circular motions; and e. a control rod extending through the opening of the housing and having one end connected to the large wheel and the other end connected to the toilet seat for transmitting pedal depressions into successive movements of the seat to and from its lifted and lowered positions.

2. The hands-free toilet seat control set forth in claim 1, wherein the gear has the size and teeth configured so that two depressions of the pedal make a 180° turn of the gear to effect a half cycle of the toilet seat travel either from its lifted to lowered positions or from its lowered to lifted positions.

3. The hands-free toilet seat control set forth in claim 1, wherein the gear has the size and teeth configured so that one depression of the pedal makes a 180° turn of the gear to effect a half cycle of the toilet seat travel either from its lifted to lowered positions or from its lowered to lifted positions.

4. The hands-free toilet seat control set forth in claim 1, wherein the oscillating member moves through a longitudinal track proximal to the gear in response to the pedal depressions to transmit the pedal force to the gear.

5. The hands-free toilet seat control set forth in claim 1, wherein the oscillating member moves through a circumferential track concentric to the axle of the gear in response to the pedal depressions to transmit the pedal force to the gear.

6. The hands-free toilet seat control set forth in claim 1, wherein the wheel has four equidistant notches circumferentially disposed extending parallel to the axle of the gear and a roller bearing operatively cyclically engaging with one of the notches to assist the ratcheting operations of the gear by halting an uncontrolled movement of the wheel and gear between depressions of the pedal.

7. The hands-free toilet seat control set forth in claim 1, wherein the overall size of the seat control is small enough for clip-on installation over a section of the rim of the toilet bowl.

8. A hands-free toilet seat control responsive to foot depressions to cycle a toilet seat between lifted and lowered positions comprising:

a. a gear rotationally mounted on a horizontal axle;

b. a ratchet mechanism having a pedal at one end and an oscillating member disposed at an opposite end, wherein the oscillating member is in ratcheting mesh with the gear to rotate the gear in a single direction when the pedal is depressed;

c. a large wheel fixed to the gear for amplifying the gear rotation into a succession of larger circular motions; and d. a control rod having one end connected to the large wheel and the other end connected to the toilet seat for transmitting pedal depressions into successive movements of the seat to and from its lifted and lowered positions.

9. The hands-free toilet seat control set forth in claim 8, wherein the oscillating member moves through a circumferential track concentric to the axle of the gear in response to the pedal depressions to transmit the pedal force to the gear.

10. The hands-free toilet seat control set forth in claim 8, wherein the wheel has four equidistant notches circumferentially disposed extending parallel to the axle of the gear and a roller bearing operatively engaging with one of the notches to assist the ratcheting operations of the gear by halting an uncontrolled movement of the wheel and gear between depressions of the pedal.

* * * * *